US005345853A

United States Patent [19]

Crepin et al.

[11] Patent Number: 5,345,853

[45] Date of Patent: Sep. 13, 1994

[54] SYSTEM FOR ANCHORING A PROJECTILE LAUNCHER TO THE GROUND

[75] Inventors: Roger Crepin, Ville d'Avray; Thierry Bredy, Asnières les Bourges, both of France

[73] Assignee: Giat Industries, Versailles, France

[21] Appl. No.: 90,175

[22] PCT Filed: Dec. 3, 1993

[86] PCT. No.: PCT/FR/92/01144

§ 371 Date: Jul. 19, 1993

§ 102(e) Date: Jul. 19, 1993

[87] PCT Pub. No.: WO93/13381

PCT Pub. Date: Jul. 8, 1993

[30] Foreign Application Priority Data

Dec. 24, 1991 [FR] France ..... 91 16061

[51] Int. Cl.[5] ..... F42B 23/14; F42B 23/16; F41F 3/042; F41A 1/10

[52] U.S. Cl. ..... 89/1.818; 89/1.35; 102/401

[58] Field of Search ..... 89/1.818, 1.35, 1.3, 89/37.05; 102/401, 424, 425, 426, 427

[56] References Cited

U.S. PATENT DOCUMENTS

| | | | |
|---|---|---|---|
| 1,198,398 | 9/1916 | Wicker | 89/1.3 |
| 1,387,308 | 8/1921 | Post | 89/1.35 |
| 4,724,740 | 2/1988 | Garcia | 89/37.05 |

FOREIGN PATENT DOCUMENTS

| | | |
|---|---|---|
| 1148066 | 12/1957 | France . |
| 2356114 | 1/1978 | France . |
| 2219651 | 12/1989 | United Kingdom . |

*Primary Examiner*—David Brown
*Attorney, Agent, or Firm*—Oliff & Berridge

[57] ABSTRACT

An anchoring system for anchoring a projectile launcher to the ground. The launcher includes a tubular body accommodating at least a projectile to be fired and a propellant charge. The system further includes least one anchoring element that penetrates the ground when the projectile is fired. The anchoring element can be moved between a first position in which it is at a distance from the ground and held by a body of the launcher by means of a temporary attachment device, and a second position in which it penetrates the ground. A control system causes the anchoring spike to move automatically from its first to its second position and is constituted by the pressure of the gases resulting from ignition of propellant charge.

19 Claims, 1 Drawing Sheet

SYSTEM FOR ANCHORING A PROJECTILE LAUNCHER TO THE GROUND

BACKGROUND OF THE INVENTION

The present invention relates to a system for anchoring a projectile launcher to the ground. The launcher includes a tubular body that rests on the ground by means of legs, in which body a projectile to be fired and a propellant charge are accommodated. The system includes at least one anchoring element that digs into the ground when the projectile is fired.

In general, a launcher of the aforementioned type rests on the ground by legs deployed manually or automatically in the case of a launcher unloaded from a carrier vehicle for example. The launcher is then oriented according to a given elevation angle and azimuth angle, these angles being predetermined or adjusted automatically when the target is detected by an associated acquisition system.

At the time the projectile is fired following ignition of a propellant charge initiated by an ignitor, the launcher is subject to mechanical constraints that can alter the adjustments of the azimuth and elevation angles of the launcher.

French Patent FR-2,356,114 describes a device for launching a flare rocket that is equipped at its rear part with an anchoring element formed by a prong that digs into the ground before the rocket is fired in order to prevent any displacement or toppling of the launch device upon firing. Specifically, the operations of adjusting the elevation and azimuth angles are effected manually by an operator who then drives the prong into the ground.

The device described in this document is designed for a projectile of the rocket type, namely a projectile that carries its own propellant charge. Thus, the forces acting on the launch support are far less than those that a mortar type projectile launcher would sustain.

Moreover, since the elevation and azimuth angles are adjusted on deployment, such a device cannot be applied to a mine of the "zone action" type which is able automatically to assume the particular elevation and azimuth angles as a function of the position and speed characteristics of a detected target.

SUMMARY OF THE INVENTION

A goal of the invention is to design a system for anchoring a projectile launcher to the ground, which overcomes the aforementioned drawbacks while providing other advantages.

For this purpose, the invention proposes an anchoring system wherein an anchoring element is slidably mounted in the launcher body and movable between a first position where it is at a distance from the ground and held to the launcher body by a temporary attachment device, and a second position where it digs into the ground. The anchor system includes a control system causing the anchor element to pass automatically from its first to its second position.

According to another characteristic of the invention, the control device of the anchoring element is constituted by the pressure of the gases resulting from ignition of a pyrotechnic charge, which charge can be that used to eject the projectile or an additional charge.

In general, the projectile, which is accommodated inside the launcher body, rests on a disk that forms a piston slidably mounted inside the launcher body, and the anchoring element is attached to a movable support slidably mounted inside the launcher body. The movable support delimits, with the piston, a variable-volume chamber in which the gases resulting from ignition of the projectile's propellant charge or additional charge diffuse.

According to a first embodiment of the invention, the movable support to which the anchoring element is attached is constituted by a tubular element whose outer wall is in slidable contact with the inner wall of the launcher body. The tubular element terminates at one end in a bottom wall outside which the anchoring element is attached, whereby the variable-volume chamber is delimited between the bottom wall of the tubular element and the supporting piston of the projectile which rests on this bottom wall.

In this first embodiment, the temporary attachment device of the anchoring element is constituted by shear pins that project from the inner wall of the launcher body, with the tubular element integral with the anchoring element abutting these pins with its bottom wall.

According to a second embodiment of the invention, the movable support is constituted by a disk mounted in sliding contact inside an intermediate tubular element provided with a bottom wall. One face of this disk is prolonged axially by the anchoring element which can freely traverse an opening provided in the wall of the intermediate tubular element, in which case the variable-volume chamber is delimited between the other face of the disk and the support piston of the projectile, which abuts the disk.

In the second embodiment, the temporary attachment device of the anchoring element is constituted by shear pins that project from the inner wall of the intermediate tubular element, whereby the disk integral with the anchoring element rests on these pins.

According to one important advantage of the invention, the anchoring system absorbs some of the forces generated at the time the projectile is fired, preventing the launcher from tilting and the settings of the elevation and azimuth angles from being altered, so that the projectile is fired accurately.

Such an anchoring system is well suited for a launcher of the zone defense type mine.

BRIEF DESCRIPTION OF THE DRAWINGS

Other advantages, characteristics, and details of the invention will emerge from the explanatory description hereinbelow, which refers to the attached drawings provided only as an example and wherein.

DETAILED DESCRIPTION OF PREFERRED EMBODIMENTS

Figure 1:
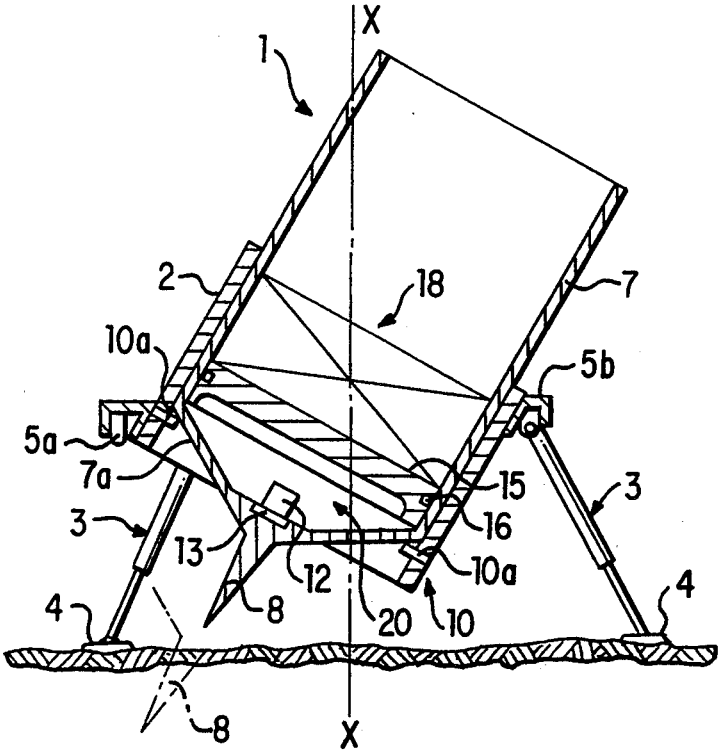
FIG. 1 is a schematic cross section of a projectile launcher equipped with system for anchoring it to the ground according to a first embodiment of the invention.

According to the first embodiment illustrated in FIG. 1, a projectile launcher 1 comprises a tubular body 2 open at both ends. Launcher 1 rests on the ground by means of legs 3. Legs 3 support, at one end, pads 4 for example designed to rest on the ground, while the other ends of legs 3 are connected to a toothed crown 5*a*. An annular plate 5b is fitted around body 2 and is integral therewith. Plate 5b supports a motor (not shown) that drives a pinion (not shown) rotationally. The pinion meshes with fixed toothed crown 5a, which causes plate 5b and body 2 to rotate about an essentially vertical axis X—X.

Legs 3 are advantageously of the telescopic type, and the degree of extension of each leg 3 is controlled by a motor (not shown) in a manner known of itself. Telescopic legs 3 and toothed crown 5 constitute angular positioning means of the launcher, namely means allowing the elevation and azimuth angles of launcher 1 to be adjusted.

The anchoring system comprises a tube 7 slidably mounted inside tubular body 2 of launcher 1, its outer wall being in sliding contact with the inner wall of body 2. Tube 7 is open at one of its ends while the other end is closed by a bottom wall 7a. In the example considered here, wall 7a is frustoconical, and its vertex is prolonged along the axis of tube 7 by at least one anchoring element 8 such as a spike.

Tube 7 is held inside tubular body 2 by means of a temporary attachment device 10 such as shear pins 10a, which project from the inner wall of tubular body 2, and which provisionally support tube 7 at the level of its bottom wall 7a. A propellant charge 12 and an ignitor 13 are placed inside tube 7 and are attached to bottom wall 7a for example.

A disk 15 forming a piston is slidably mounted inside tube 7. An outer side wall of disk 15 has a circular recess that accommodates a gasket 16, which is in contact with the inner wall of tube 7. Disk 15 abuts bottom wall 7a of tubular element 7, delimiting therewith a variable-volume chamber 20. A projectile 18 is accommodated inside tube 7 and rests on disk 15.

In general, launcher 1 as described above can be deployed manually or dropped off from a carrier vehicle for example in a manner known of itself. Once launcher 1 is in contact with the ground, its telescopic legs 3 are extended a sufficient length maintaining the free end of anchoring spike 8 at a certain distance from the ground in order not to impede adjustments of the elevation and azimuth angles of launcher 1.

As soon as the acquisition system (not shown) associated with launcher I detects a target, a control unit calculates the elevation and azimuth angles to aim launcher 1 in the direction of the target. For this purpose, the length of each telescopic leg 3 is adjusted so as to adjust the elevation angle of launcher 1, and plate 5b integral with body 2 of launcher 1 is driven rotationally by toothed crown 5a so that it is oriented according to the desired azimuth angle.

Launcher 1 is then operational and propellant charge 12 is ignited by triggering ignitor 13. The gases resulting from the ignition of propellant charge 12 diffuse in variable-volume chamber 20. The gas pressure prevailing in this chamber 20 increases and causes displacement of tube 7 due to the shearing of pins 10a and movement of piston 15 in two opposite directions. Displacement of tube 7 causes anchoring spike 8 to dig into the ground to a depth that is a function of the kinetic energy acquired by tube 7 and the nature of the ground. Movement of piston 15 causes ejection of projectile 18 in the desired direction, in a manner known of itself. However, it is important to note that tube 7 and projectile 18 do not have the same inertia so that they move at different speeds such that anchoring of spike 8 occurs before projectile 18 leaves tube 7.

In general, when propellant charge 12 is ignited, the pressure rise in chamber 20 is sudden. As a result there is a pressure peak that communicates kinetic energy to anchoring spike 8 on the one hand via tube 7 and to projectile 18 on the other hand via piston 15. As an example, the value of this pressure peak is approximately 5 to 10 MPa (the pressure reached in one to two milliseconds) to propel a 10 to 30 kg projectile. The velocity imparted to spike 8 is sufficient to ensure anchoring of launcher 1 to the ground.

Figure 2:
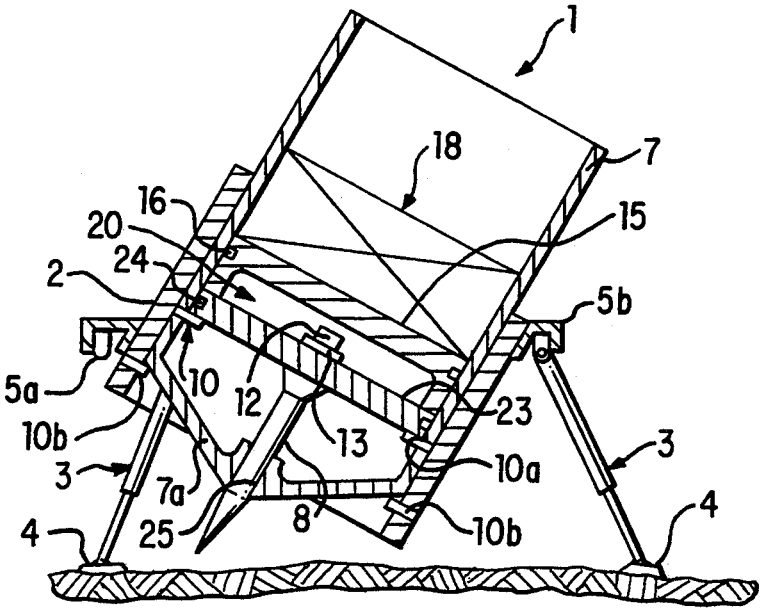
FIG. 2 is a schematic cross section through a projectile launcher equipped with a system for anchoring it to the ground according to a second embodiment of the invention.

In the second embodiment illustrated in FIG. 2, anchoring spike 8 is supported by an intermediate disk 23. Disk 23 is mounted inside tube 7 in slidable contact by its lateral surface with the inner wall of tube 7, with interposition of an annular gasket 24. Disk 23 is held in tube 7 by gluing for example, or by means of pins 10a. Anchoring spike 8 is attached at the center of one face of disk 23 and projects outside tube 7 by a central opening 25 provided in bottom wall 7a of tube 7.

Tube 7, accommodated inside body 2, is held by shear pins 10b attached to the inner wall of body 2. Tube 7 rests on pins 10b by its bottom wall 7a, said pins 10b having a greater strength than that of pins 10a that hold disk 23.

Disk 15, which forms the piston and supports projectile 18, abuts the other face of disk 23 so that they delimit between them a variable-volume chamber 20. Propellant charge 12 and its ignitor 13 are accommodated in chamber 20 and are attached to disk 23 for example.

The adjustments of the elevation and azimuth angles of tubular body 2 are effected, as in the previous embodiment, by means of telescopic legs 3 and toothed crown 5a after acquisition of a target. The gas pressure inside chamber 20, resulting from combustion of propellant charge 12, causes displacement of disk 23, following the shearing of pins 10a, and displacement of piston 15 in opposite directions. Displacement of disk 23 causes anchoring spike 8 to dig into the ground, and displacement of piston 15 causes ejection of projectile 18, whereby spike 8 becomes anchored before projectile 18 leaves tube 7 for the same reasons as stated in the case of FIG. 1. However, it should be noted that if spike 8 is still not yet fully anchored in the ground when disk 23 comes in contact with bottom wall 7a of tube 7, pins 10b are sheared and tube 7 is pulled in the ground direction by anchoring spike 8.

The embodiment in FIG. 2 has the advantage over that in FIG. 1 that the launch tube may have a smaller total height, which makes it easier to camouflage on the ground.

Of course, the invention is not confined to the embodiments described above and comprises all the technical equivalents of the means described without departing from the framework of the invention. In particular, in the case where the launcher is deployed manually, the telescopic legs can be adjusted manually to position plate 5b horizontally. Finally, it is possible to use different shapes for the anchoring element, and to provide several such elements.

What is claimed is:

1. System for anchoring a projectile launcher to a penetrable supporting surface, wherein the launcher comprises a tubular body resting on the surface through legs, said tubular body accommodating at least a projectile to be fired and a propellant charge, the system comprising:

at least one anchoring element, said anchoring element being slidably mounted in said tubular body and movable between a first position and a second position, said anchoring element being held in said first position by a detachable attachment device, said anchoring element, in said second position, penetrating the surface when the projectile is fired; and control means for causing the anchoring element to pass automatically from the first position to the second position.

2. Anchoring system according to claim 1, wherein said anchoring element is in the shape of a spike.

3. Anchoring system according to claim 1, wherein said detachable attachment device comprises breakable pins.

4. Anchoring system according to claim 1, further comprising:

a support slidably mounted inside said tubular body and supporting said anchoring element; and a piston slidably mounted inside said tubular body, said piston supporting said projectile, wherein said piston and said movable support define a variable-volume chamber.

5. Anchoring system according to claim 4, wherein the inertias of said projectile and said anchoring element are different, so that said anchoring element is anchored in the surface before said projectile is ejected.

6. Anchoring system according to claim 4, wherein said support comprises a tubular element having a bottom wall, said anchoring element being attached to an outer face of said bottom wall.

7. Anchoring system according to claim 1, wherein by the control means is constituted by the pressure of the gases resulting from ignition of a pyrotechnic charge.

8. Anchoring system according to claim 7, wherein the pyrotechnic charge is the propellant charge for ejecting projectile.

9. Anchoring system according to claim 8, further comprising:

a support slidably mounted inside said tubular body and supporting said anchoring element; and a piston slidably mounted inside said tubular body, said piston supporting said projectile, wherein said piston said movable support define a variable-volume chamber.

10. Anchoring system according to claim 9, wherein said anchoring element is integral with said support.

11. Anchoring system according to claim 9, wherein said pyrotechnic charge is accommodated in said chamber.

12. Anchoring system according to claim 11, wherein the inertias of said projectile and said anchoring element are different, so that said anchoring element is anchored in the surface before said projectile is ejected.

13. Anchoring system according to claim 9, wherein said support comprises a tubular element having a bottom wall said anchoring element being attached to an outer face of said bottom wall.

14. Anchoring system according to claim 13, wherein said detachable attachment device is mounted between said tubular body and said tubular element.

15. Anchoring system according to claim 9, wherein said support comprises a disk slidably mounted inside an intermediate tubular element, said intermediate tubular element having a bottom wall comprising an opening, said tubular element being slidably mounted inside said body, wherein said anchoring element is attached to one face of said disk and projects through said opening.

16. Anchoring system according to claim 15, wherein said detachable attachment device is mounted between said intermediate tubular element and said disk.

17. Anchoring system according to claim 16, wherein said intermediate tubular element is held in a first position by a second detachable attachment device connected to said tubular body.

18. Anchoring system according to claim 15, wherein said intermediate tubular element is held in a first position by a second detachable attachment device connected to said tubular body.

19. Anchoring system according to claim 18, wherein the second temporary attachment device comprises a higher breaking strength than that of said first temporary attachment device.

* * * * *